US007275570B2

(12) United States Patent
McGlinchy et al.

(10) Patent No.: US 7,275,570 B2
(45) Date of Patent: Oct. 2, 2007

(54) DESICCANT DISPENSING SYSTEM

(75) Inventors: Timothy McGlinchy, Twinsburg, OH (US); John Grismer, Cuyahoga Falls, OH (US)

(73) Assignee: Glass Equipment, Inc., Twinsburg, OH (US)

( * ) Notice: Subject to any disclaimer, the term of this patent is extended or adjusted under 35 U.S.C. 154(b) by 239 days.

(21) Appl. No.: 10/922,745

(22) Filed: Aug. 20, 2004

(65) Prior Publication Data

US 2006/0037665 A1 Feb. 23, 2006

(51) Int. Cl.
*B67C 3/26* (2006.01)

(52) U.S. Cl. ..... 141/283; 141/177; 141/135; 141/62

(58) Field of Classification Search ..... 141/177–179, 141/283, 135, 35, 36, 62, 164
See application file for complete search history.

(56) References Cited

U.S. PATENT DOCUMENTS

| | | | | |
|---|---|---|---|---|
| 3,280,523 | A | 10/1966 | Stroud et al. | |
| 3,788,370 | A * | 1/1974 | Hare et al. | 141/238 |
| 4,088,522 | A | 5/1978 | Mercier et al. | |
| 4,145,237 | A | 3/1979 | Mercier et al. | |
| 4,530,195 | A | 7/1985 | Leopold | |
| 4,546,723 | A | 10/1985 | Leopold et al. | |
| 4,564,410 | A | 1/1986 | Clitheros et al. | |
| 4,787,332 | A | 11/1988 | Geisel et al. | |
| 4,964,362 | A | 10/1990 | Dominguez | |
| 5,044,309 | A | 9/1991 | Crumbach et al. | |
| 5,105,591 | A | 4/1992 | Leopold | |
| 5,136,974 | A | 8/1992 | Lisec | |
| 5,295,292 | A | 3/1994 | Leopold | |
| 5,361,476 | A | 11/1994 | Leopold | |
| 5,932,062 | A | 8/1999 | Manser | |
| 6,017,578 | A | 1/2000 | Trautmann et al. | |
| 6,197,231 | B1 | 3/2001 | Lisec | |
| 6,286,288 | B1 | 9/2001 | France | |
| 6,293,317 | B1 * | 9/2001 | Burgi et al. | 141/283 |
| 6,368,408 | B1 | 4/2002 | Schuler | |
| 6,494,245 | B1 | 12/2002 | Simone | |
| 6,630,028 | B2 * | 10/2003 | Briese et al. | 156/578 |
| 6,722,403 | B2 * | 4/2004 | Zhou et al. | 141/178 |
| 6,851,460 | B2 * | 2/2005 | Tamai | 141/285 |
| 2005/0178490 | A1 * | 8/2005 | McGlinchy | 156/64 |

FOREIGN PATENT DOCUMENTS

| | | |
|---|---|---|
| EP | 0709539 | 5/1996 |

* cited by examiner

*Primary Examiner*—Khoa D. Huynh
(74) *Attorney, Agent, or Firm*—Tarolli, Sundheim, Covell & Tummino LLP

(57) ABSTRACT

A method and apparatus for controlling dispensing of a desiccant material into an interior region of an elongated spacer frame member. The appropriate desiccant dispensing nozzle is automatically selected and/or the distance between the desiccant dispensing nozzle and the elongated spacer frame member is automatically determined based on a property of the spacer frame member, such as the width of the spacer frame member.

27 Claims, 13 Drawing Sheets

DESICCANT DISPENSING SYSTEM

FIELD OF THE INVENTION

The present invention relates to insulating glass units and, more particularly, to a method and apparatus for applying desiccant to spacer frame assemblies used in constructing insulating glass units.

BACKGROUND

Insulating glass units (IGU's) are used in windows to reduce heat loss from building interiors during cold weather or to reduce heat gain in building interiors during hot weather. IGU's are typically formed by a spacer assembly that is sandwiched between glass lites. The spacer assembly usually comprises a frame structure that extends peripherally around the unit, an adhesive material that adheres the glass lites to opposite sides of the frame structure, and desiccant in an interior region of the frame structure for absorbing atmospheric moisture within the IGU. The glass lites are flush with or extend slightly outwardly from the spacer assembly. The adhesive is disposed on opposite outer sides of the frame structure about the frame structure periphery, so that the spacer is hermetically sealed to the glass lites. An outer frame surface that defines the spacer periphery may also be coated with sealant, which increases the rigidity of the frame and acts as a moisture barrier.

One type of spacer construction employs a U-shaped, roll formed aluminum or steel elements connected at its end to form a square or rectangular spacer frame. Opposite sides of the frame are covered with an adhesive (e.g., a hot melt material) for securing the frame to the glass lites. The adhesive provides a barrier between atmospheric air and the IGU interior. Desiccant is deposited in an interior region of the U-shaped frame element. The desiccant is in communication with the air trapped in the IGU interior and removes any entrapped water vapor and thus impedes water vapor from condensing within the IGU. After the water vapor entrapped in the IGU is removed, internal condensation only occurs when the seal between the spacer assembly and the glass lites fails or the glass lites are cracked.

SUMMARY

The present invention concerns a method and apparatus for controlling dispensing of a desiccant material into an interior region of an elongated spacer frame member. The appropriate desiccant dispensing nozzle is automatically selected and/or the distance between the desiccant dispensing nozzle and the elongated spacer frame member is automatically determined based on a property of the spacer frame member, such as the width of the spacer frame member.

In one embodiment of the method, one of a plurality of nozzles is indexed to a delivery site located along a path of travel of the elongated spacer frame member. The elongated spacer frame member is moved along the path of travel relative to the delivery site at a controlled speed. Controlled amounts of the desiccant material are dispensed through the nozzle at the delivery site to the interior region of the elongated spacer frame member. A width of the elongated spacer frame member may be monitored in a variety of ways and the nozzle appropriate nozzle can automatically be indexed to the delivery site based on the monitored width of the spacer frame member.

In one embodiment of the method, one or more of the nozzles are used to dispense desiccant material into elongated spacer members having a range of widths. For example, when a first elongated spacer frame member having a first width is moved toward the delivery site, a nozzle is automatically positioned at a first distance above the path of travel that corresponds to the first width. The nozzle delivers controlled amounts of the desiccant material to the interior region of the first elongated spacer frame member. When a second elongated spacer frame member having a second width is moved toward the nozzle, the nozzle is automatically positioned at a second distance above the path of travel that corresponds to the second width. Controlled amounts of the desiccant material are dispensed through the nozzle to the interior region of the second elongated spacer frame member. In one embodiment, the width of the desiccant material applied by the nozzle at the delivery site to the elongated spacer frame member is adjusted by adjusting the relative distance between the spacer frame member and the nozzle at the delivery site.

In one embodiment, the volume of desiccant material per unit of spacer frame member length is selected based on a moisture vapor transfer rate of an insulated glass unit constructed with the elongated spacer frame member. The volume of desiccant material per unit of spacer frame member length may be constant for a range of spacer frame widths.

One system for controlled dispensing of a desiccant material into an interior region of an elongated spacer frame member includes a plurality of nozzles, a nozzle indexing actuator, a conveyor and a controller. The actuator selectively indexes each of the plurality of nozzles to a delivery site located along a path of travel of the elongated spacer frame member. The conveyor moves the elongated spacer frame members along the path of travel relative to the delivery site at a controlled speed. The controller selects a nozzle indexed to the delivery site based on a width of an elongated spacer frame member approaching the delivery site.

Another system for controlled dispensing includes a nozzle, a nozzle adjustment actuator, a conveyor and a controller. The nozzle adjustment actuator positions the nozzle above a delivery site located along a path of travel of the elongated spacer frame member. The controller determines the distance between the nozzle and the elongated spacer frame member at the delivery site based on a width of an elongated spacer frame member approaching the delivery site.

Additional features of the invention will become apparent and a fuller understanding obtained by reading the following detailed description in connection with the accompanying drawings.

DETAILED DESCRIPTION

Figure 1:
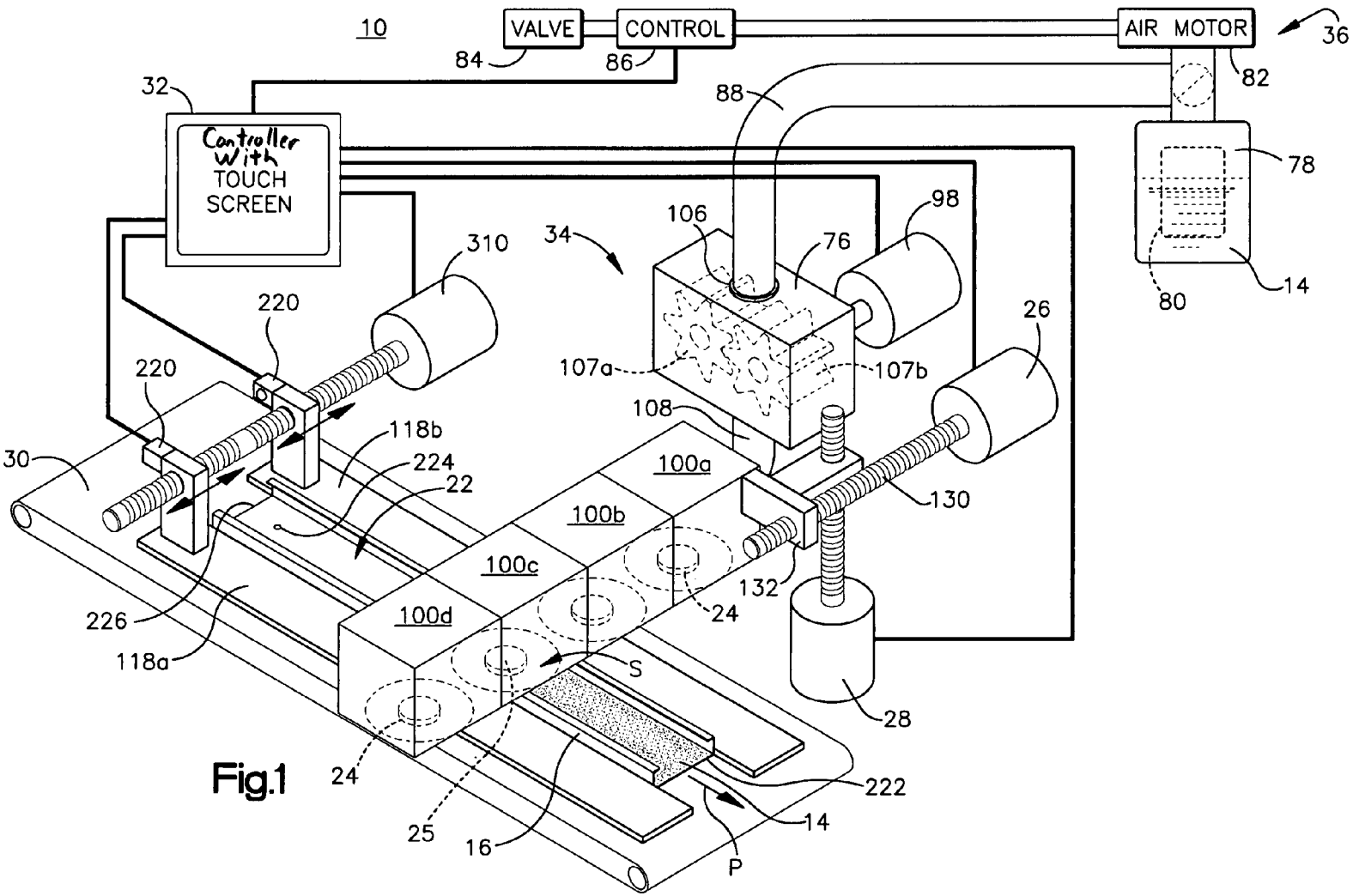
FIG. 1 is a schematic representation of a system for applying desiccant to elongated spacer frame members used in constructing insulating glass units.
Figure 2:
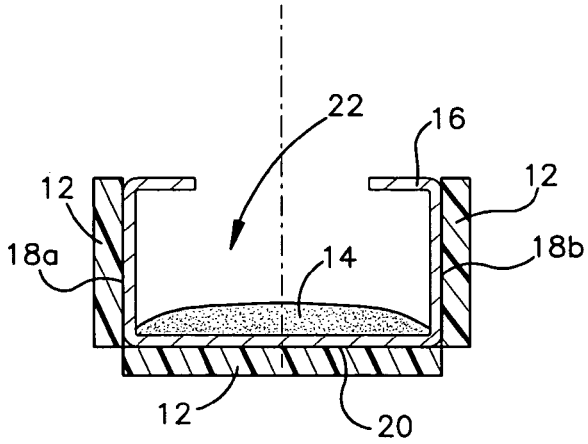
FIG. 2 is a front elevational view of an elongated spacer member with adhesive and desiccant applied to it.

FIG. 1 schematically illustrates a system 10 for controlled dispensing of a desiccant 14 into an interior region 22 of elongated window spacer 16. The system automatically selects an appropriate desiccant dispensing nozzle 24 and/or automatically determines an appropriate distance D (FIGS. 6 and 7) between the desiccant dispensing nozzle 24 and the elongated spacer frame member 16 based on a property of the spacer frame member 16, such as a width W of the spacer frame member. The system 10 applies desiccant 14 to the interior region 22 of the elongated window spacer 16. Adhesive 12 is also applied on the glass abutting walls 18*a*, 18*b* to facilitate attachment of glass lites (FIGS. 2 and 8) of an assembled insulated glass unit. Adhesive 12 on the outer wall 20 (FIG. 2) strengthens the elongated window spacer 16 and allows for attachment of external structure. The desiccant 14 applied to the interior region 22 of the elongated window spacer 16 captures any moisture that is trapped within an assembled insulating glass unit.

The system illustrated by FIG. 1 includes a plurality of nozzles 24, a nozzle indexing actuator 26, a nozzle height adjusting actuator 28, a conveyor 30, and a controller 32. An indexed nozzle 25 positioned above a path of travel P selectively opens to dispense the desiccant material 14 into the interior region 22 of the elongated spacer frame member. The remainder of the nozzles remain closed when the indexed nozzle 25 is dispensing desiccant. The nozzle indexing actuator 26 selectively indexes each of the nozzles 24 to a delivery site S located along the path of travel of the elongated spacer frame member. The nozzle height adjusting actuator 28 positions the nozzle above the conveyor at the delivery site. The conveyor 30 moves the elongated spacer frame member 16 along the path of travel relative to the delivery site at a controlled speed. The controller 32 monitors widths W (FIGS. 6 and 7) of elongated spacer frame members conveyed to the delivery site. The controller selects the indexed nozzle 25 based on the width W of an elongated spacer frame member 16 conveyed to the delivery site S. The conveyor also determines the appropriate distance D between the nozzle and the elongated spacer frame member 16 at the delivery site based on the width W of an elongated spacer frame member conveyed to the delivery site. Details of one acceptable controller 32 are described in U.S. Pat. No. 6,630,028 to Briese et al., which is incorporated herein by reference in its entirety.

In the embodiment illustrated by FIG. 1, the system 10 includes a desiccant metering and dispensing assembly 34, a desiccant bulk supply 36, the conveyor 30 and the controller 32. The desiccant bulk supply 36 supplies desiccant 14 under pressure to the desiccant metering and dispensing assembly 34. The desiccant metering and dispensing assembly 34 monitors pressure of the desiccant 14 supplied by the desiccant bulk supply 36. The controller 32 regulates the pressure of the desiccant 14 delivered to the desiccant metering and dispensing assembly 34 based on the pressures sensed by the desiccant metering and dispensing assembly 34. The conveyor 30 moves the elongated window spacer 16 past the desiccant metering and dispensing assembly 34 at a rate of speed controlled by the controller 32.

In the exemplary embodiment the desiccant metering and dispensing assembly 34 includes a desiccant metering pump 76 which is a gear pump in the exemplary embodiment. The speed of the desiccant dispensing gear pump 76 is controlled to dispense the desired amount of desiccant through the indexed nozzle 25 to the interior region 22 of the elongated spacer member 16. The desiccant metering and dispensing assembly 34 dispenses the desired amount of desiccant 14 into the interior region 22 of the elongated window spacer 16 as the elongated window spacer 16 is moved past the desiccant metering and dispensing assembly 34 by the conveyor 32.

Referring to FIG. 1, the desiccant bulk supply 36 includes a desiccant reservoir 78 filled with desiccant 14, a shovel pump mechanism 80, an air motor 82, an exhaust valve 84, an electropneumatic regulator 86, and a hose 88. One acceptable shovel pump mechanism for desiccant is model no. MHMP41042SP, manufactured by Glass Equipment Development. The desiccant electropneumatic regulator 86 regulates the pressure applied to the desiccant 14 by the desiccant air motor 82. One acceptable electropneumatic regulator 86 is model no. QB1TFEE100S560-RQ00LD, produced by Proportion-Air. The hose 88 extends from an outlet of the shovel pump mechanism 80 to an inlet 106 of the desiccant gear pump 76. In the exemplary embodiment, the desiccant reservoir 78 is a 55 gallon drum filled with desiccant 14. In one embodiment, the desiccant is heated before it is applied. One acceptable heated desiccant is HL-5157, produced by H. B. Fuller. In a second embodiment, the desiccant is applied cold (i.e., at room temperature). One acceptable cold desiccant is PRC-525 made by PRC-525-DM. The shovel pump mechanism 80 delivers desiccant 14 under pressure to the hose 88. In the exemplary embodiment, the shovel pump mechanism 80 heats the desiccant 14 to condition it for application by the desiccant metering and dispensing assembly 34. To stop additional pressure from being applied to the desiccant 14, the exhaust valve 84 is selectively opened. One acceptable desiccant shovel pump 80 for supplying heated desiccant is model no. MHMP41024SP, produced by Glass Equipment Development. One acceptable pump 80 for supplying cold desiccant is model no. MCFP 1031 SP, produced by Glass Equipment Development.

Most manufacturing facilities generate approximately 100 psi of air pressure. The piston diameter ratio of the desiccant shovel pump mechanism 80 amplifies the air pressure provided by the manufacturing facility by a factor of 42 to 1. Magnification of the air pressure provided by the facility enables the shovel pump mechanism 80 to supply desiccant 14 at a maximum pressure of 4200 psi to the desiccant hose 88.

In one embodiment, when heated material is used, the desiccant hose 88 is a 1 inch diameter insulated hose and is approximately 10 feet long. In another embodiment, when cold desiccant is used a 1 inch diameter non-insulated hose is used. The pressure of the desiccant 14 as it passes through the hose 88 will drop approximately 1000 psi as it passes through the hose 88, resulting in a maximum desiccant pressure of 3200 psi at the inlet 106 of the adhesive metering and dispensing assembly 34.

In the embodiment illustrated by FIGS. 1, 13-18 and 19, the desiccant metering and dispensing assembly 34 includes a desiccant gear pump 76, a desiccant gear pump motor 98, and a plurality of desiccant dispensing guns 100 in series. Referring to FIG. 1, desiccant 14 is supplied under pressure by the desiccant bulk supply 36 via the hose 88 to the inlet 106 of the desiccant gear pump 76. Controlled rotation of pump gears 107*a*, 107*b* of by the desiccant gear pump motor 98 meters and supplies desiccant 14 to the line of desiccant dispensing guns 100 through a desiccant gear pump outlet 108.

In the exemplary embodiment, the desiccant dispensing guns 100 are snuff-back valve-type dispensing guns that utilizes an air cylinder to apply an upward force on a stem that extends to a nozzle 24 when the needle valve is closed. To dispense desiccant 14, a solenoid valve of the indexed dispensing gun 100 causes the air cylinder 110 to move the desiccant stem 112 away from the air cylinder and a sealing seat of the indexed nozzle 25, allowing desiccant 14 to flow through an open orifice of the nozzle indexed 25. The remainder of the dispensing guns 100 remain closed. As such, desiccant is dispensed only through the indexed nozzle 25. In the embodiment illustrated by FIG. 1, an inlet of a first dispensing gun 100*a* is provided with desiccant by an outlet of the metering pump 76, an inlet of a second dispensing gun 100*b* is provided with desiccant by an outlet of the first dispensing gun 100*a*, an inlet of a third dispensing gun 100*c* is provided with desiccant by an outlet of the second dispensing gun 100*b*, and an inlet of a fourth dispensing gun 100*d* is provided with desiccant by an outlet of the third dispensing gun 100*c*. It should be readily apparent that any number of dispensing guns could be included in the desiccant metering and dispensing assembly. One suitable desiccant dispensing gun 100 is model no. 2-15266, manufactured by Glass Equipment Development.

Figure 10A:
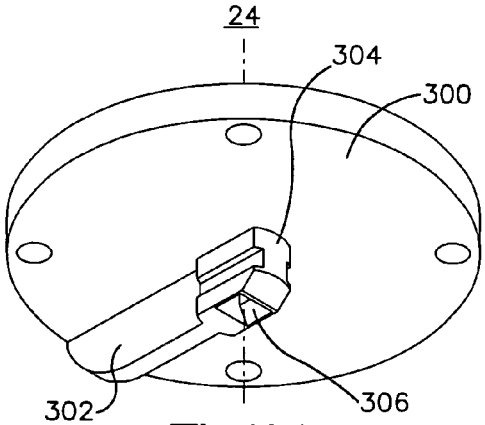
FIG. 10A is a perspective view of a nozzle.
Figure 10B:
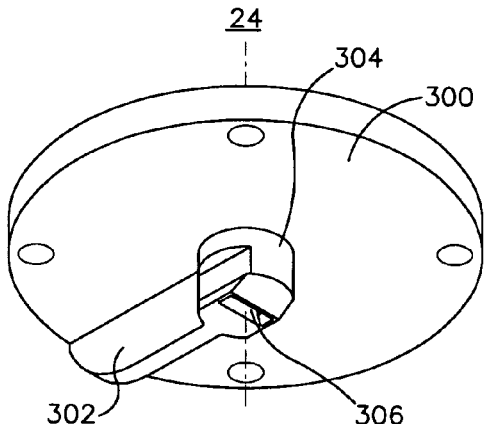
FIG. 10B is a perspective view of a nozzle.

In the exemplary embodiment, each nozzle 24 can be used to deliver desiccant to a range of elongated spacer frame widths. For example, a first nozzle may be sized to apply desiccant to elongated spacer members having widths ranging from 11/32" to 13/32". A second nozzle may be sized to apply desiccant to elongated spacer members having widths ranging from 1/2" to 19/32". A third nozzle may be sized to apply desiccant to elongated spacer members having widths ranging from 19/32" to 21/32". FIGS. 10A and 10B illustrate two differently sized nozzles 24. The nozzles illustrated in FIGS. 10A and 10B are single integral members that each include a mounting plate 300, a guide pin 302, and a dispensing tip 304. The mounting plate 300 facilitates attachment to a dispensing gun. The guide pin 302 inhibits significant misalignment of elongated spacer frame members with respect to the nozzle 24. The dispensing tip 304 includes an orifice 306 through which the desiccant is dispensed.

Referring to FIGS. 10A and 10B, the system 10 includes a variety of differently sized nozzles 24 to accommodate spacers having various widths. For example, the system may include six nozzles to accommodate spacers having widths ranging from 7/32" to 7/8". In the exemplary embodiment, the system monitors the widths W of elongated spacer frame members approaching the delivery site. The width may be monitored in a variety of ways. For example, a schedule may be imported to the controller that includes the widths of each of the elongated spacer frame members that will be processed by the system, the width of the approaching spacer may be provided by a machine that forms the elongated spacer frames, and/or the widths of approaching spacer frame members may be measured. Once the width of the approaching elongated spacer frame member or group of elongated spacer frame members is known, the appropriate nozzle is automatically indexed to the delivery site based on the monitored width of the approaching spacer frame member(s). For example, a nozzle that accommodates 1/2" to 19/32" wide elongated spacer frame members would automatically be indexed to the delivery site when the system 10 determines that a 9/16" wide spacer frame is approaching the delivery site.

Figure 4:
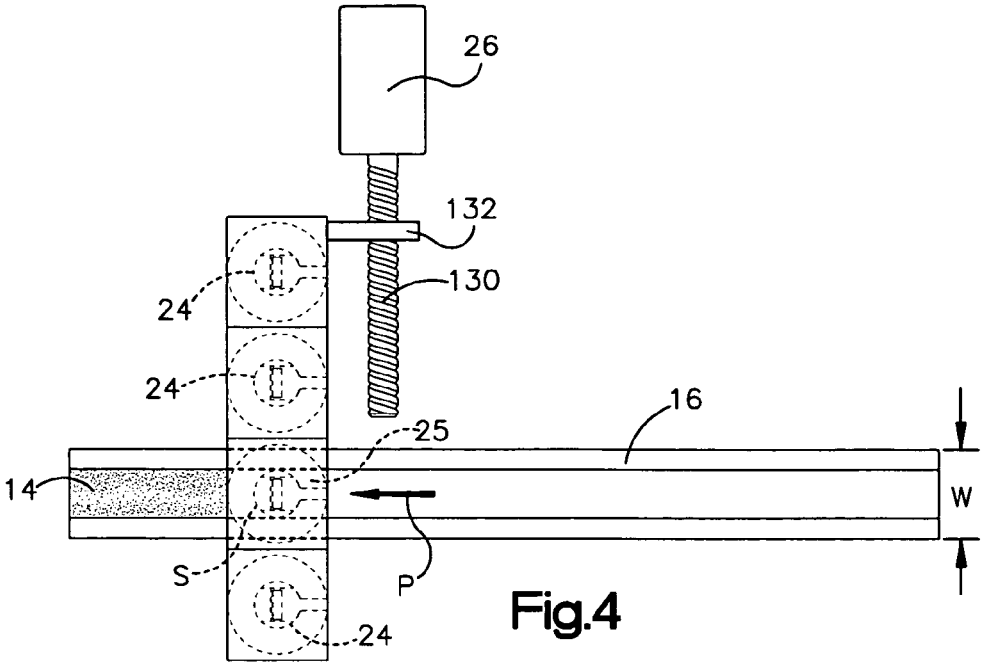
FIG. 4 is a schematic illustration of a plurality of indexable nozzles positioned above an elongated spacer frame member having a first width.
Figure 5:
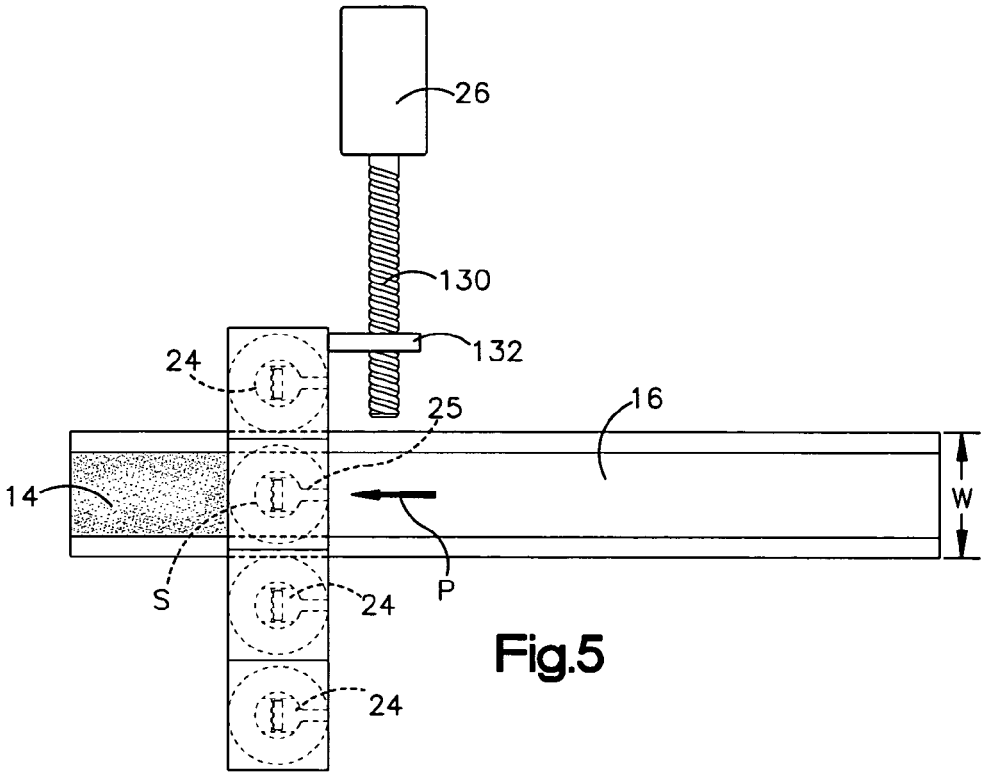
FIG. 5 is a schematic illustration of a plurality of indexable nozzles positioned above an elongated spacer frame member having a second width.

Referring to FIGS. 4 and 5, the nozzles 24 are indexed by the nozzle indexing actuator 26 that is controlled by the controller. In the illustrated embodiment, the nozzle indexing actuator 26 is a motor. The nozzle indexing actuator 26 drives an externally threaded shaft 130 that is coupled to a plate 132. The plate 132 is connected to the nozzles 24, such that rotation of the shaft 130 by the nozzle indexing actuator 26 linearly moves the plate 132 and nozzles 24. In FIG. 4 the indexed nozzle 25 corresponds to the width of the elongated spacer frame illustrated in FIG. 4. When the width of the elongated spacer frame member 16 shown in FIG. 5 is sensed, the nozzle indexing actuator 26 rotates the shaft 130 to index the nozzle that corresponds to the width of the elongated spacer frame illustrated in FIG. 5 to the delivery site.

In the embodiment illustrated by FIGS. 13-21, the dispensing guns 100, the desiccant metering pump 76, and the desiccant pump motor 98 are mounted to a carriage 134. The carriage 134 is mounted to a rail 136 such that the carriage is laterally moveable with respect to the rail. The plate 132 is fixed to the carriage 134. The nozzle indexing actuator 26 and a bearing plate 138 (FIGS. 15 and 16) are fixed with respect to the rail 136. The threaded shaft 130 extends from the nozzle indexing actuator 26, through the plate 132, and is supported by a bearing 140 mounted in the bearing plate 138. Rotation of the threaded shaft 130 linearly moves the plate 132 and carriage 134 along the rail. The carriage linearly moves the dispensing guns 100, the desiccant metering pump 76, and the desiccant pump motor 98 as a unit to index the appropriate nozzle 24 to the delivery site.

Figure 11:
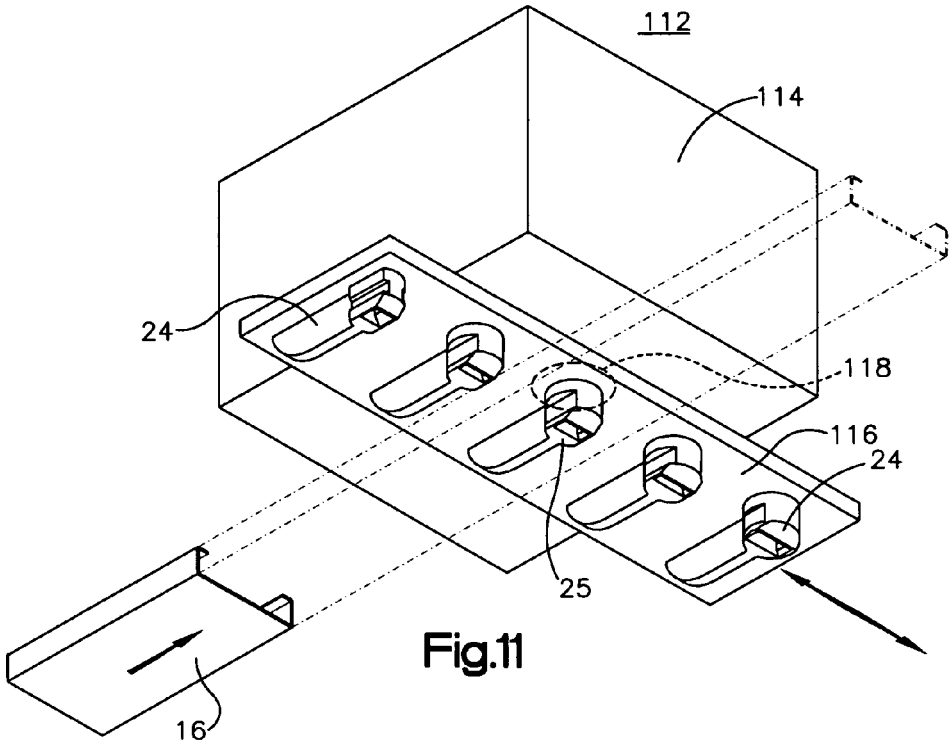
FIG. 11 illustrates a plurality of nozzles carried by a nozzle carrying plate.

FIG. 11 illustrates a dispensing gun 112 of an alternate embodiment. The dispensing gun includes a single valve assembly 114, and a plurality of nozzles 24 carried by an indexable nozzle carrying plate 116. The valve assembly 114 selectively dispenses desiccant 14 through an opening 118 that is positioned above the desiccant delivery site. The nozzle carrying plate 116 can be linearly moved to position each of the nozzles over the opening 118 at the delivery site. Once the appropriate nozzle 24 is positioned at the delivery site, the valve assembly 114 is controlled to dispense desiccant through the opening 118 and through the indexed nozzle 25 to the delivery site.

Figure 12:
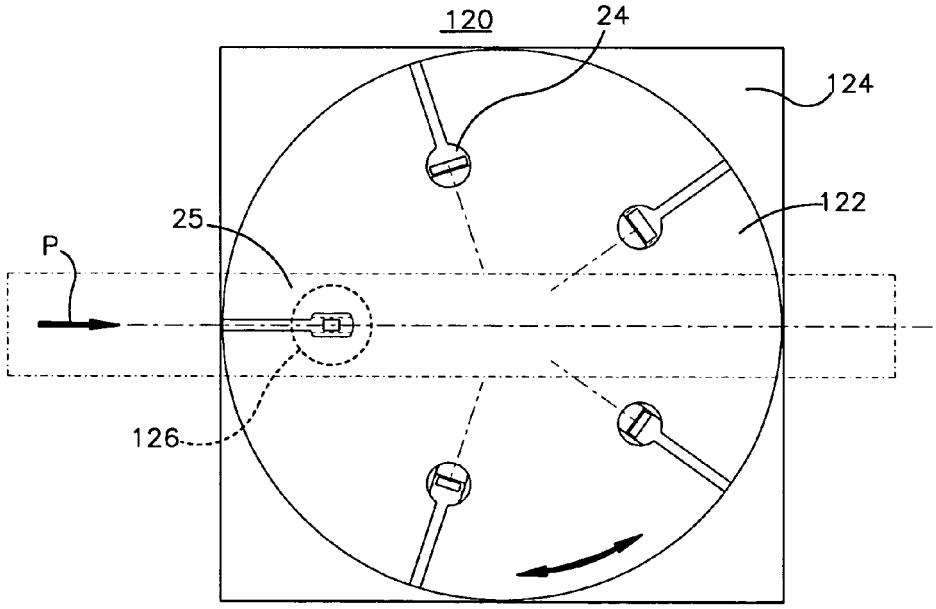
FIG. 12 illustrates a plurality of nozzles carried by a turret.

FIG. 12 illustrates a dispensing gun 120 of an alternate embodiment. The dispensing gun includes a single valve assembly 124, and a plurality of nozzles 24 carried by an indexable turret manifold 122. The valve assembly 124 selectively dispenses desiccant 14 through an opening 126 that is positioned above the desiccant delivery site. The turret can be rotated to position each of the nozzles over the opening 126 at the delivery site. Once the appropriate nozzle 24 is positioned at the delivery site, the valve assembly 124 is controlled to dispense desiccant through the indexed nozzle 25 to the delivery site. In the exemplary embodiment, the nozzles are arranged on the turret 122 such that only one nozzle is positioned in the path P of travel of the elongated window spacers 16 at a time.

In the exemplary embodiment, each nozzle 24 can be used to deliver desiccant to a range of elongated spacer frame widths. For example, a first nozzle may be sized to apply desiccant to elongated spacer members having widths ranging from 11/32" to 13/32". A second nozzle may be sized to apply desiccant to elongated spacer members having widths ranging from 1/2" to 19/32". A third nozzle may be sized to apply desiccant to elongated spacer members having widths ranging from 19/32" to 21/32".

Figure 6:
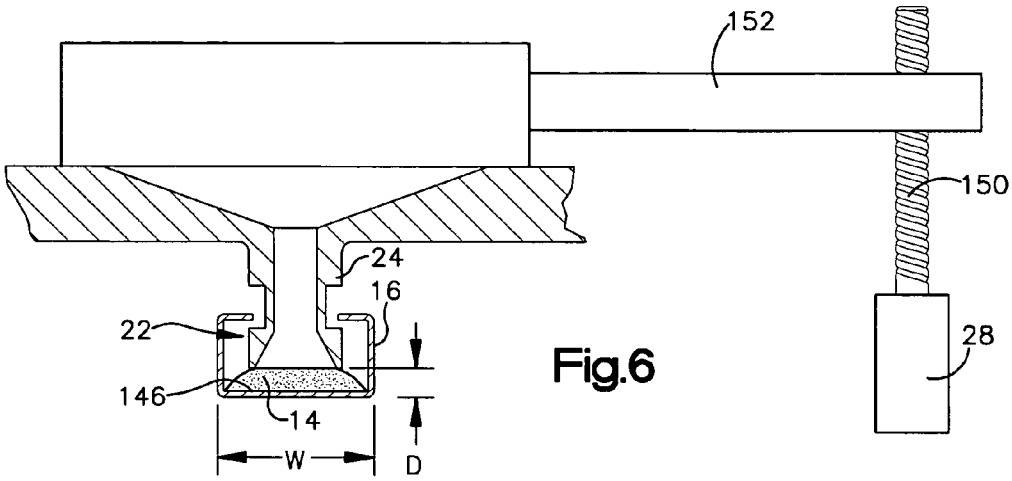
FIG. 6 is a schematic illustration of a nozzle positioned at a first height with respect to an elongated spacer frame member.
Figure 7:
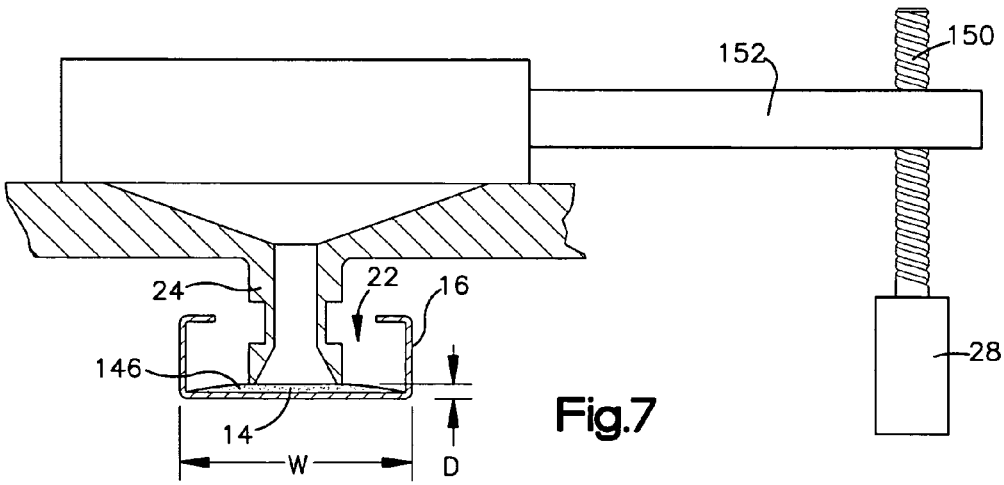
FIG. 7 is a schematic illustration of a nozzle positioned at a second height with respect to an elongated spacer frame member.

Referring to FIGS. 6 and 7, the height of the indexed nozzle 25 is vertically adjusted with respect to the path of travel based the width W of an elongated spacer frame member approaching the delivery site. In the exemplary embodiment, the width of the elongated spacer frame member approaching the delivery site is monitored and the indexed nozzle 25 is automatically vertically adjusted with respect to the elongated spacer frame member to a distance D above the spacer frame member that corresponds to the width of the spacer frame member. As is illustrated by FIGS. 6 and 7, by adjusting the relative distance between the spacer frame member and the nozzle at the delivery site, the width of the desiccant material applied by the nozzle to the elongated spacer frame member is adjusted.

Referring to FIGS. 6 and 7, the nozzles 24 are vertically positioned by a nozzle height adjusting actuator 28 that is controlled by the controller. In the exemplary embodiment, the nozzle height adjusting actuator 28 is a motor. The nozzle height adjusting actuator 28 drives an externally threaded shaft 150 that is coupled to a plate 152. The plate 152 is connected to the nozzles 24, such that rotation of the shaft 150 by the nozzle height adjusting actuator 28 linearly moves the plate 152 and nozzles 24. In FIG. 6 the vertical position corresponds to the width of the elongated spacer frame illustrated in FIG. 6. When the width of the elongated spacer frame member 16 shown in FIG. 7 is sensed, the nozzle height adjusting actuator 28 rotates the shaft 150 to move the indexed nozzle 25 to a height that corresponds to the width of the elongated spacer frame illustrated in FIG. 7 to the delivery site.

In the embodiment illustrated by FIGS. 13-21, lateral rail 136 that supports lateral carriage 134 carrying the dispensing guns 100, the desiccant metering pump 76, and the desiccant pump motor 98 is mounted to a vertical carriage 154. The carriage 154 is mounted to a pair of rails 156 such that the carriage is vertically moveable with respect to the rails 156. The plate 152 is fixed to the vertical carriage 154. The nozzle height adjusting actuator 28 is fixed with respect to the pair of rails 156. The threaded shaft 150 extends from the vertically adjusting nozzle height adjusting actuator 28 through the plate 152. Rotation of the threaded shaft 150 linearly moves the plate 152 and carriage 154 along the pair of rails. The carriage vertically moves the dispensing guns 100, the desiccant metering pump 76, and the desiccant pump motor 98 to appropriately position the indexed nozzle above the delivery site for the approaching elongated spacer frame member(s).

Figure 8:
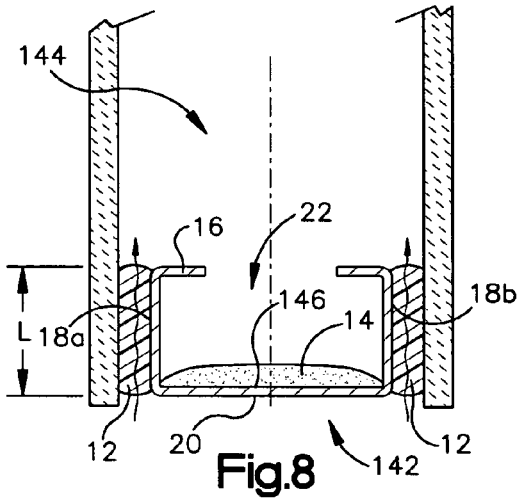
FIG. 8 illustrates an insulating glass unit having a first width.
Figure 9:
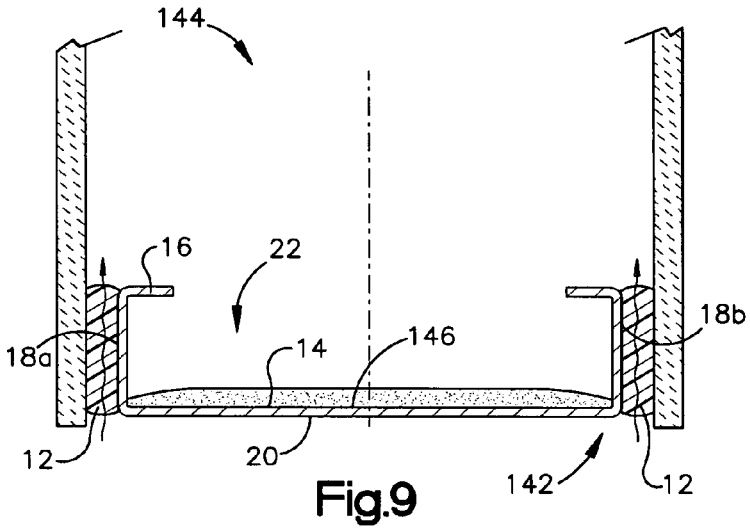
FIG. 9 illustrates an insulating glass unit having a second width.

In one embodiment, the volume of desiccant material per unit of spacer frame member length applied by a nozzle 25 is based on a moisture vapor transfer rate of an insulated glass unit constructed with the elongated spacer frame member. Referring to FIGS. 8 and 9, the moisture vapor transfer rate is dependant on the length L of the path from the exterior 142 to the interior 144 of the insulating glass unit. In the example illustrated by FIGS. 8 and 9, this length L is dictated by the width of the adhesive 12 applied to the side walls 18*a*, 18*b*. This length L may be approximately the same for insulating glass units with different spacer frame widths. As a result, the volume of desiccant material per unit of spacer frame member length can be constant for a range of spacer frame widths. In the example illustrated by FIGS. 8 and 9, the length L of the path from the exterior 142 to the interior 144 is approximately the same for wider spacer frame member illustrated by FIG. 9 as the narrower spacer frame member illustrated by FIG. 8. As a result, approximately the same amount of desiccant 14 can be used in the insulating glass unit illustrated by FIG. 9 as the insulating glass unit illustrated by FIG. 8. The height of the indexed nozzle 25 can be adjusted as illustrated by FIGS. 6 and 7 to adjust the width of the bead of desiccant applied to the elongated spacer members. In the example of FIGS. 6 and 7, the indexed nozzle 25 is moved closer to the spacer frame member, such that the same volume of desiccant material per unit length applied in the narrower spacer frame member of FIG. 6 is spread out to cover the entire interior wall 146 of the wider spacer frame member of FIG. 7. The application of the same volume of desiccant material per unit length to cover the entire interior wall a wider spacer can also be accomplished by indexing a larger nozzle to the delivery site.

The volume of desiccant 14 dispensed by the desiccant metering and dispensing assembly 34 can be precisely metered by controlling the speed of the gears 107*a*, 107*b* of the desiccant gear pump motor 98. As long as material is continuously supplied to the inlet of the desiccant gear pump 98, the same volume of desiccant is dispensed for each revolution of the gears 107*a*, 107*b*. In the exemplary embodiment, the desiccant metering and dispensing assembly 34 includes a manifold which delivers the desiccant 14 from the hose 88 to the desiccant gear pump 76 and delivers the desiccant 14 from the desiccant gear pump 76 to the line of desiccant dispensing guns 100. A known amount of desiccant 14 is dispensed for every revolution of the desiccant gear pump 76. In the exemplary embodiment, the desiccant gear pump 76 provides 20 $cm^3$ of desiccant 14 per revolution of the desiccant gear pump 76.

Figure 13:
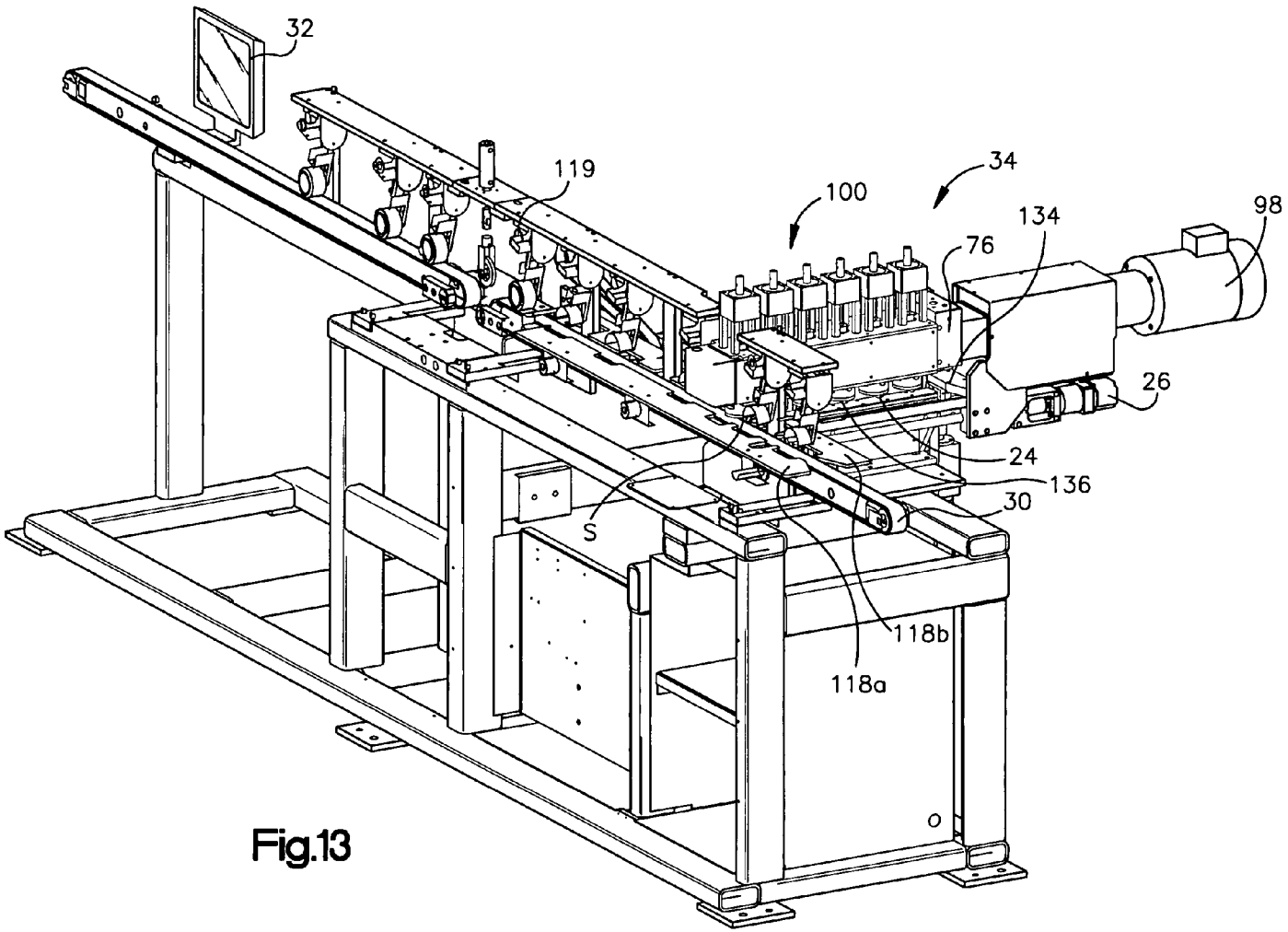
FIG. 13 is a perspective view of a system for controlled dispensing of desiccant.
Figure 14:
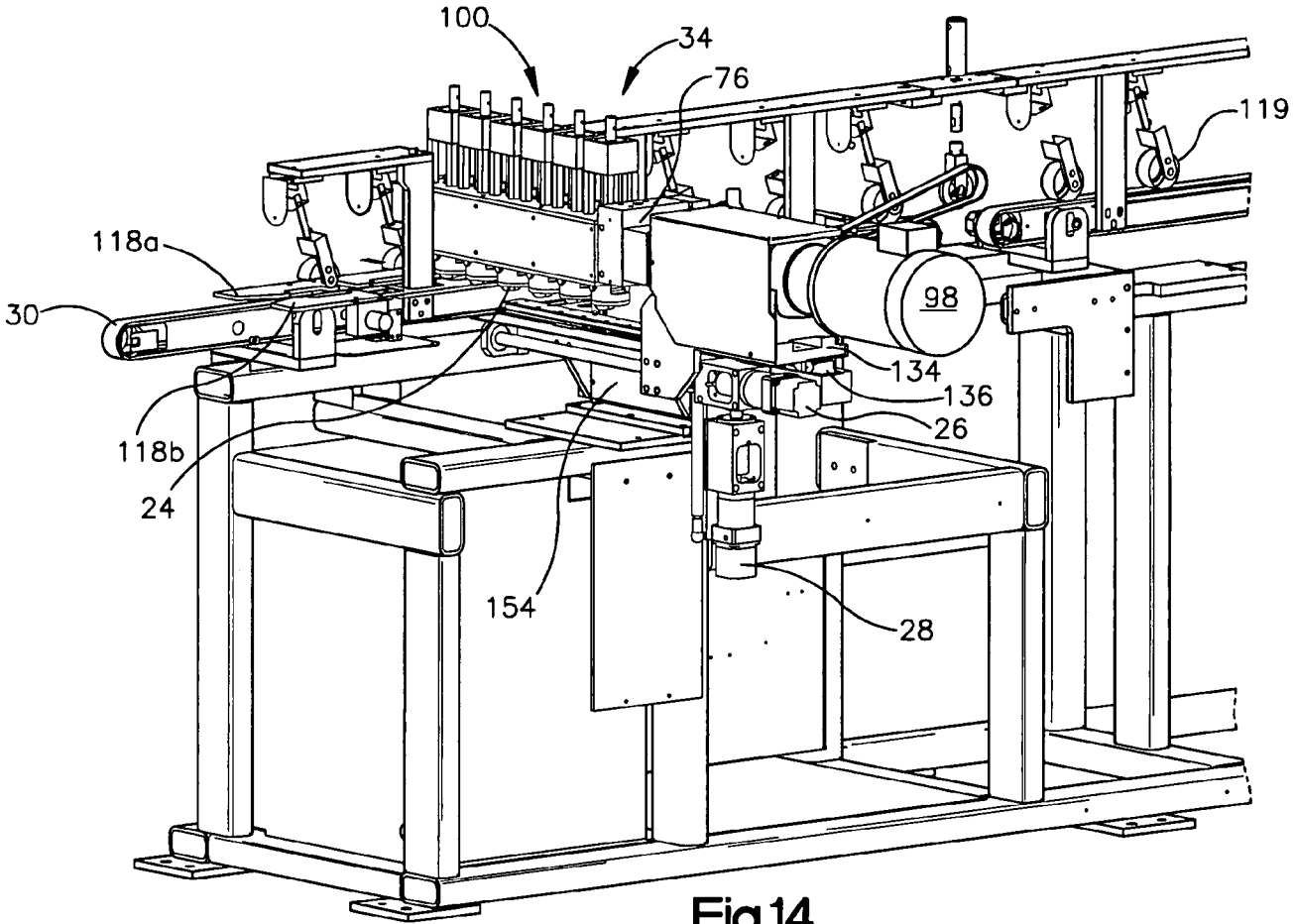
FIG. 14 is a perspective view of a system for controlled dispensing of desiccant.
Figure 15:
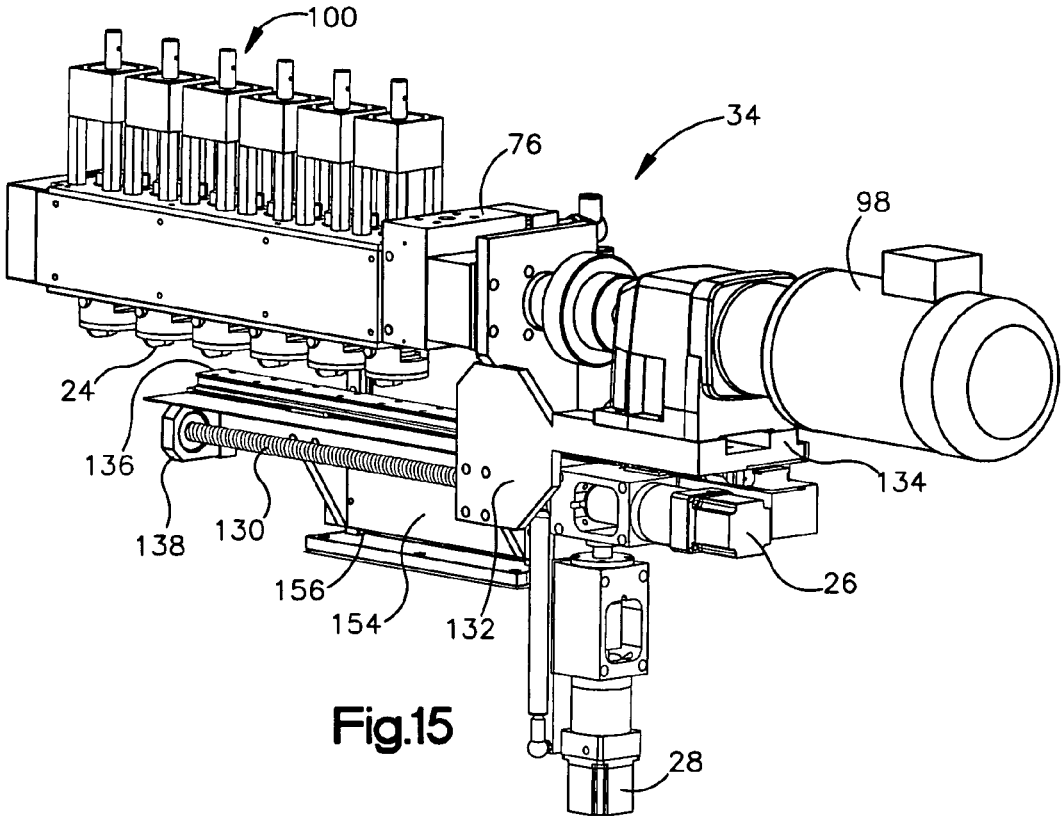
FIG. 15 is a perspective view of a multiple station desiccant dispensing assembly.
Figure 16:
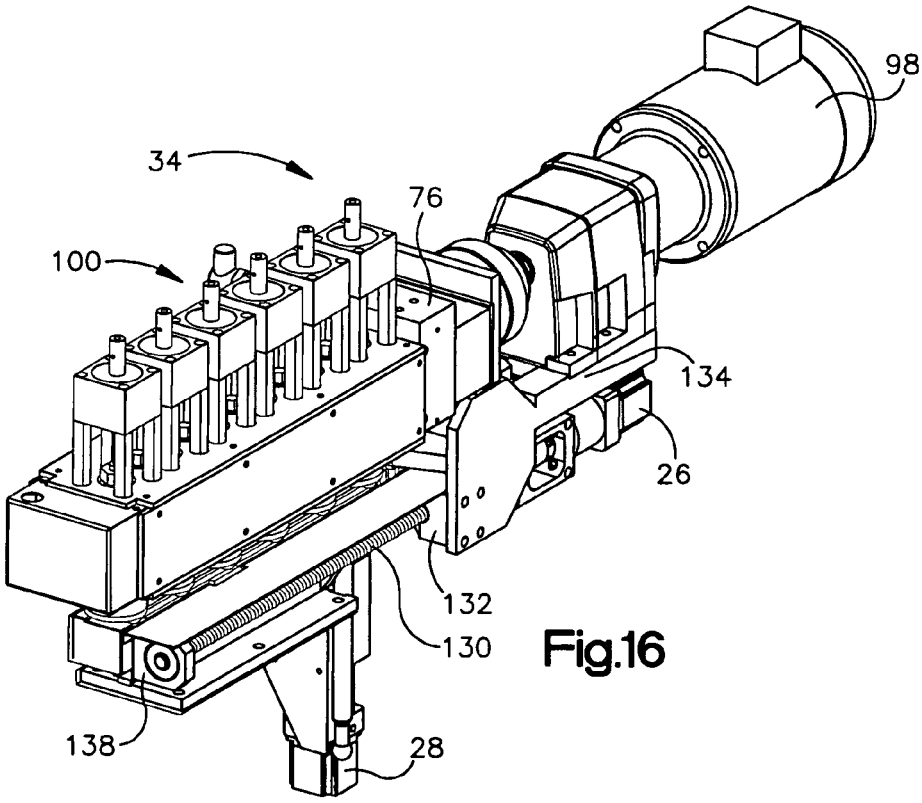
FIG. 16 is a perspective view of a multiple station desiccant dispensing assembly.
Figure 18:
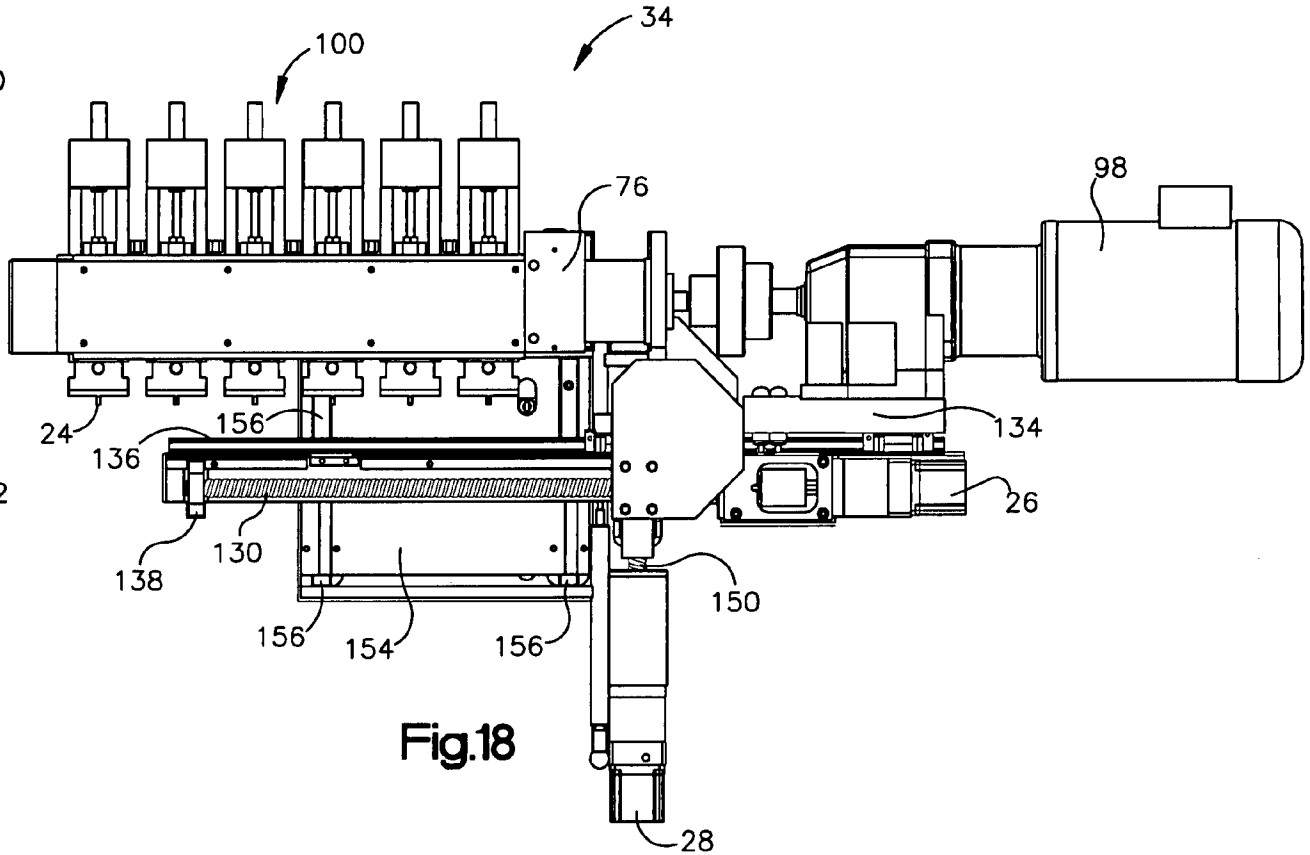
FIG. 18 is a side elevational view of a multiple station desiccant dispensing assembly.
Figure 17:
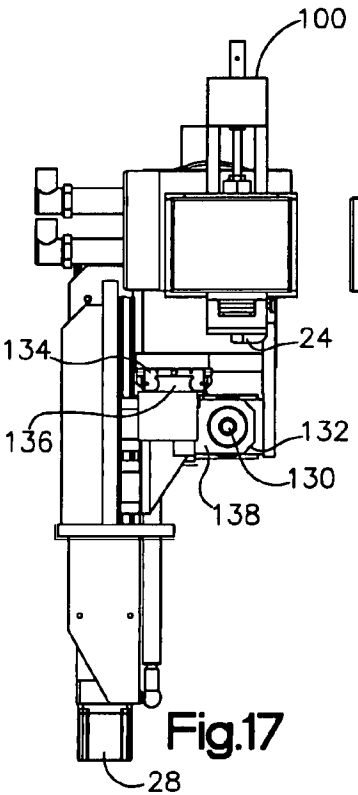
FIG. 17 is an end elevational view of a multiple station desiccant dispensing assembly.
Figure 19:
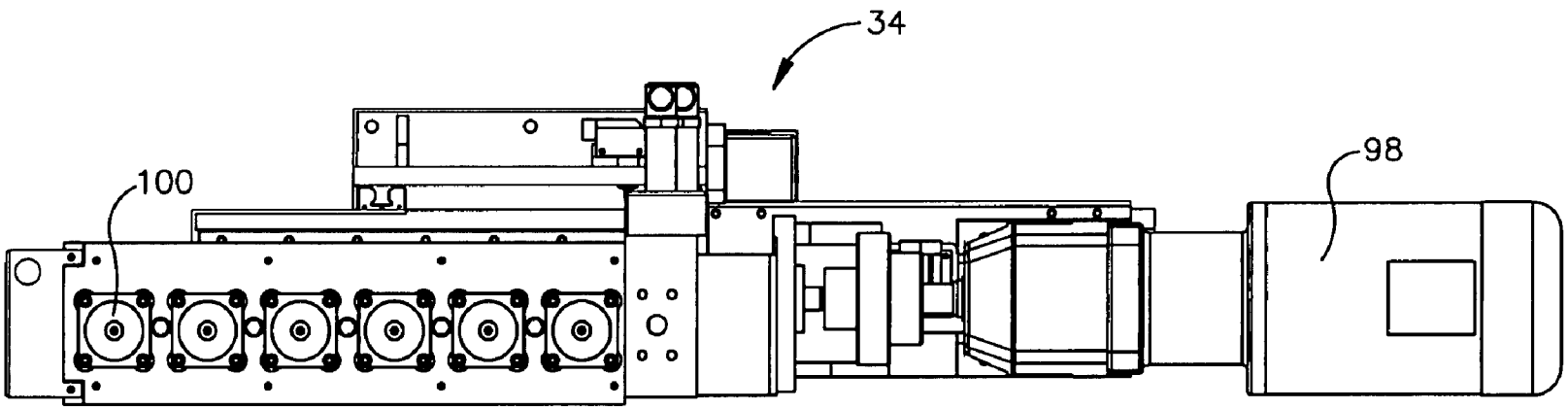
FIG. 19 is a plan view of a multiple station desiccant dispensing assembly.
Figure 20:
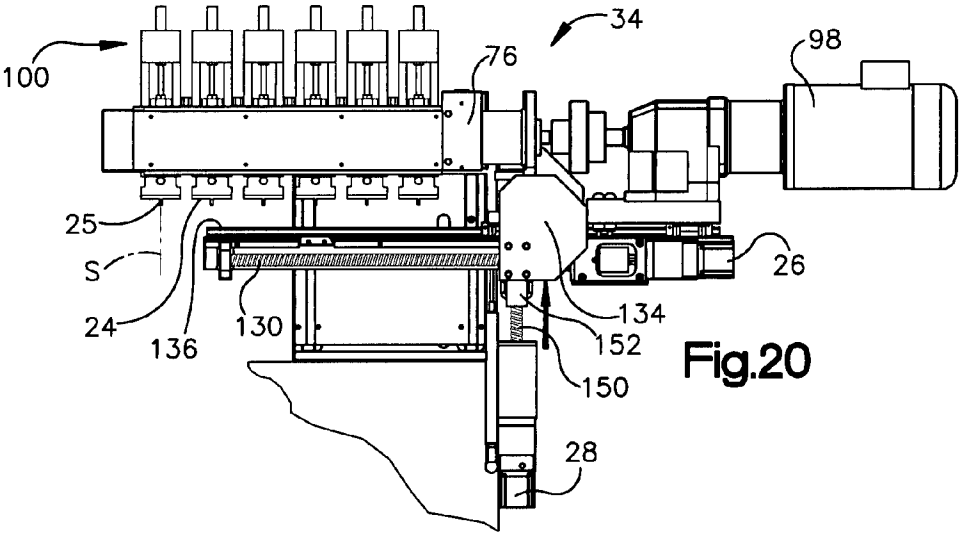
FIG. 20 is a side elevational view of a multiple station desiccant dispensing assembly.
Figure 21:
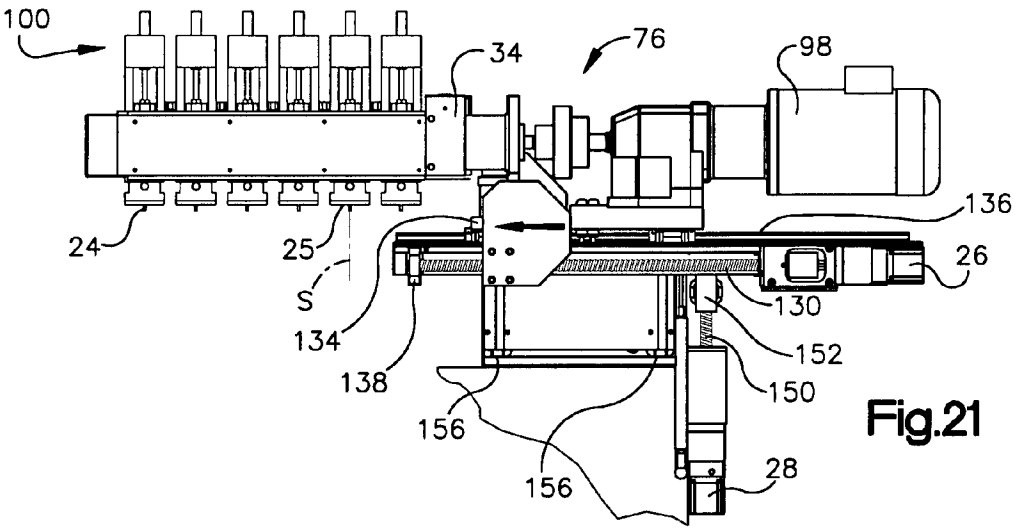
FIG. 21 is a side elevational view of a multiple station desiccant dispensing assembly.

Referring to FIGS. 1 and 13, the conveyor 32 moves elongated window spacers 16 past the desiccant metering and dispensing assembly 34. The desiccant metering and dispensing assembly 34 applies desiccant 14 to an interior region 22 of the elongated window spacer 16 as the conveyor 32 moves the elongated window spacer 16 beneath the indexed nozzle 25. The indexed desiccant dispensing gun 100 is located at the delivery site, directly above the conveyor 32, allowing desiccant 14 to be dispensed into the interior region 22 of the elongated window spacer 16 as the elongated window spacer moves past the indexed desiccant dispensing gun 100.

Referring to FIG. 1, the system 10 includes first and second conveyor guides 118*a*, 118*b* which guide the elongated window spacer 16 and position the window spacer in the center of the conveyor 32 as the elongated window spacer moves along the conveyor. The conveyor guides 118*a*, 118*b* are automatically moved toward and away from each other by a servo motor 310 (FIG. 1) based on the width of the approaching elongated spacer frame member(s). In the exemplary embodiment, the conveyor guides 118*a*, 118*b* are automatically adjust to accommodate spacers having widths ranging from 7/32" to 7/8". The system 10 illustrated in FIGS. 13 and 14 also includes rolling guides 119 (some removed to simplify drawing) that hold elongated spacers 16 firmly against the conveyor 32 as the spacer is moved along the conveyor. In the exemplary embodiment, the guides include wheels that are forced toward the conveyor by a spring loaded mechanism.

Figure 3:
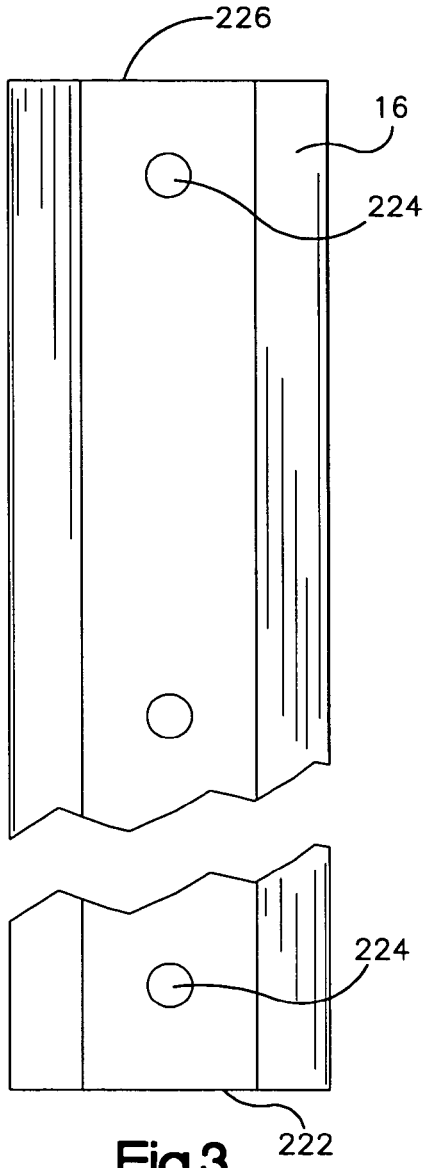
FIG. 3 is a top plan view of an elongated spacer frame member.

Referring to FIG. 1, a pair of desiccant fiber optic sensors 220 is shown mounted in relation to the conveyor 32 at a point along the path of the conveyor 32 before the delivery site. In the disclosed embodiment of the invention there are two desiccant fiber optic sensors. The desiccant fiber optic sensors sense a leading edge 222, gas holes 224 and a trailing edge 226 of an elongated window spacer 16 (see FIG. 3). The desiccant fiber optic sensors 220 provide a signal to the controller 32 when the sensor 220 senses a leading edge, a gas hole or the trailing edge of an elongated spacer 16. The controller 32 uses this signal to determine when the elongated spacer member 16 will pass under the nozzle 114 of the desiccant metering and dispensing assembly 26.

Figure 22:
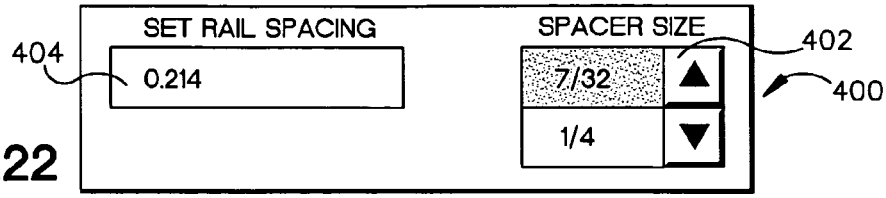
FIG. 22 is an illustration of a guide rail setup screen.

Referring to FIG. 1, the controller 32 includes a touch sensitive display 135 for both inputting parameters and displaying information. During a setup sequence, the user is prompted to enter a target conveyor speed, to enter the width between the guide rails 118*a*, 118*b* for each spacer frame width, to calibrate the vertical home position of the nozzles, to calibrate the horizontal home position of each nozzle, to enter the number of active desiccant nozzles, to assign a nozzle position to each spacer size, to assign an amount of desiccant per unit length for each spacer size, and to assign a nozzle height to each spacer size. FIG. 22 illustrates a rail spacing setup screen 400. A spacer size selection box 402 allows the user to select each spacer size. A rail spacing selection box 404 allows the user to set the desired rail spacing for the selected spacer size.

Figure 23:
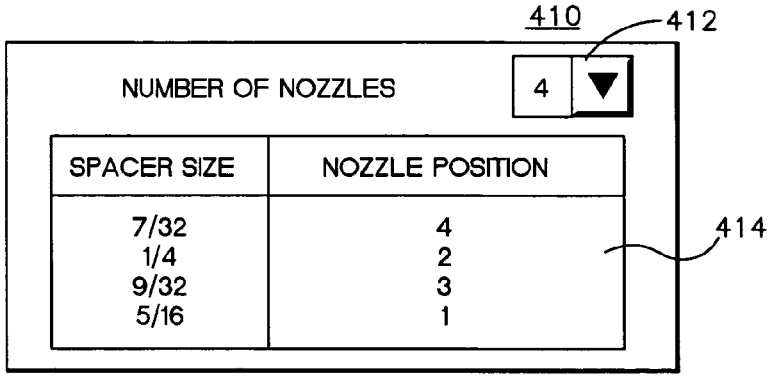
FIG. 23 is an illustration of a nozzle position setup screen.

FIG. 23 illustrates a nozzle position setup screen 410. A number of nozzles box 412 allows the user to select the number of active desiccant nozzles 24. A nozzle position box 414 allows the user to assign a nozzle position to each spacer size.

Figure 24A:
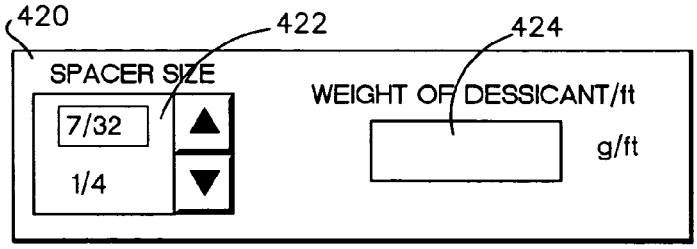
FIG. 24A is an illustration of a desicant amount setup screen.

FIG. 24A illustrates an amount of desiccant by weight setup screen 40. A spacer size selection box 422 allows the user to select each spacer size. A weight of desiccant per unit length input box 424 allows the user to input the weight of desiccant per unit of spacer frame length for each spacer frame size.

Figure 24B:
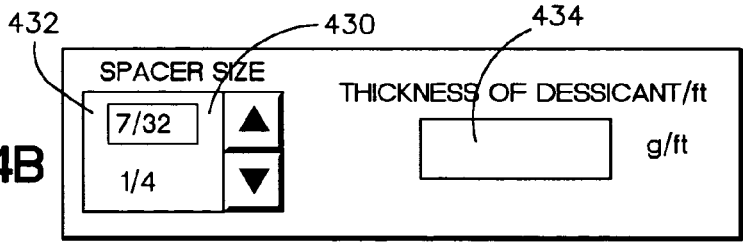
FIG. 24B is an illustration of a desicant amount setup screen.

FIG. 24B illustrates a thickness of desiccant screen 430, which may be used by the user instead of by the weight setup screen 420. A spacer size selection box 432 allows the user to select each spacer size. A thickness of desiccant box 434 allows the user to input the designed thickness of desiccant to be applied to the selected spacer frame width.

Figure 25:
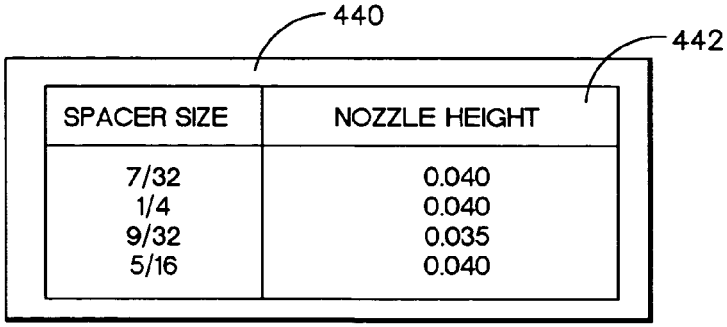
FIG. 25 is an illustration of a nozzle height setup screen.

FIG. 25 illustrates a nozzle height setup screen 440. A nozzle height box allows the user to assign a nozzle height to each spacer size.

The controller 32 control the speed of the conveyor 32, the pressure supplied by the desiccant bulk supply 36, the speed at which the motor 98 turns the desiccant gear pump 76, and the time at which the indexed desiccant gun 100 dispenses desiccant as well as other parameters.

By supplying desiccant 14 to the gear pumps 76 at an appropriate pressure (typically between 600 psi and 1500 psi) and controlling the speed at which the motor drives the gear pump, the volumetric flow rate of desiccant 14 is accurately controlled.

The required volumetric flow and speed at which the desiccant motor 98 drives the desiccant pump 76 is calculated by the controller 32. The required volumetric flow of desiccant 14 is equal to the cross-sectional area of the desiccant applied multiplied by the velocity of the elongated window spacer 16 along the conveyor 32. The required pump speed is equal to the required volumetric flow of desiccant 14 divided by the volume of desiccant flow produced for each revolution of the desiccant pump 76.

In the embodiment where the mass or volume of the desiccant 14 per length of window spacer 16 is inputted into the controller 32, via the touch screen 135. The controller 32 calculates the required volumetric flow of desiccant 14 by multiplying the inputted mass per elongated window spacer 16 length by the speed of the conveyor 32. The speed at which the desiccant pump 76 must be driven by the desiccant gear pump motor 98 is equal to the required desiccant volumetric flow rate divided by the flow created by each revolution of the desiccant gear pump 76.

The indexed nozzle 25 is selected, the height of the indexed nozzle is adjusted, and the distance between the conveyor guides 118*a*, 118*b* are adjusted automatically by servo motors based on the widths of elongated spacer members scheduled to be processed by the system. An elongated window spacer 16 is placed on the conveyor 32 (either manually or automatically by an automated delivery device or from a machine that forms elongated spacers from ribbon stock) with the outer wall 20 in contact with the conveyor 32 and the glass abutting walls 18*a*, 18*b* constrained by the conveyor guides 118*a*, 118*b*. The rolling guides 119 hold the elongated spacer 116 firmly against the conveyor 32 as the spacer is moved along the conveyor. The conveyor 32 moves the elongated window spacer 16 toward the desiccant metering and dispensing assembly 34. The leading edge 222, gas holes 224 and trailing edge 226 of the elongated window spacer pass beneath the desiccant fiber optic sensor 220. The desiccant fiber optic sensor 220 senses the leading edge, the gas holes 224 and the trailing edge 226 and provides a signal to the controller 32 indicating the time at which the leading edge, gas holes and trailing edge pass beneath the desiccant fiber optic sensor 120. The controller 32, uses the input from the desiccant fiber optic sensor and the speed of the conveyor 32 to calculate the time at which the leading edge, gas holes and trailing edge of the elongated window spacer 16 will pass the indexed nozzle 25.

Referring to FIG. 1, the elongated window spacer 16 is moved by the conveyor 32 past the desiccant dispensing gun 100. When the leading edge 222 of the elongated window spacer 16 reaches the indexed nozzle 25, desiccant 14 is dispensed into the interior region 22 of the elongated spacer beginning at the leading edge. Desiccant 14 is applied to the interior region as the elongated spacer is moved past the desiccant dispensing gun 100. The desiccant gear pump motor 98 drives the desiccant gear pump 76 at the required speed to supply the desired amount of desiccant 14 into the interior region 22 of the elongated window spacer 16.

In one embodiment, when a gas hole 224 of the elongated window spacer 16 passes beneath the desiccant dispensing gun 100, dispensing of desiccant into the interior region 222 is temporarily stopped, leaving the gas holes 224 open. In the exemplary embodiment, the controller 32 causes the desiccant dispensing gun 100 to begin dispensing desiccant again after the gas hole 124 passes the desiccant dispensing gun 100. In an alternate embodiment, desiccant 14 is applied over the gas holes 124. In this embodiment, the controller 32 causes the desiccant dispensing gun 100 to continue dispensing desiccant 14 as each gas hole 124 passes beneath the desiccant dispensing gun 100. This option of applying desiccant over the gas holes, may be programmed by the user into the controller 32 via the touch screen 135 during the setup sequence.

The desiccant dispensing gun 100 continues to dispense desiccant 14 into the interior region 22 until the trailing edge 226 of the elongated window spacer 16 is reached. In one embodiment, the controller stops dispensing of desiccant 14 at the trailing edge 126 of the elongated window spacer 16 based on the position of the trailing edge 126 sensed by the desiccant fiber optic sensor 120. In an alternate embodiment, the controller 32 stops dispensing of desiccant 14 into the interior region 22 based on a length parameter that is inputted into the controller 32 via the touch screen 135.

Although the present invention has been described with a degree of particularity, it is the intent that the invention include all modifications and alterations falling within the spirit or scope of the appended claims.

The invention claimed is:

1. A method of controlling dispensing of a desiccant material into an interior region of an elongated spacer frame member, comprising:

a) moving an elongated spacer frame member along a path of travel relative to a desiccant material delivery site at a controlled speed;

b) monitoring a width of the elongated spacer frame member;

c) automatically indexing a selected one nozzle chosen from a plurality of available desiccant material delivery nozzles to said desiccant material delivery site based on the width of said elongated spacer frame member; and d) delivering controlled amounts of the desiccant material through the selected one nozzle at the delivery site to the interior region of the elongated spacer frame member.

2. The method of claim 1 wherein at least one nozzle of the plurality of nozzles is selected to deliver desiccant to a range of multiple different elongated spacer frame widths.

3. The method of claim 1 wherein the automatic indexing of the selected nozzle comprises moving the selected nozzle transversely to the travel path and further comprising vertically adjusting the selected nozzle with respect to the path of travel based on a width of an elongated spacer frame member approaching the delivery site.

4. The method of claim 1 further comprising monitoring a width of the elongated spacer frame member and automatically vertically adjusting the selected nozzle with respect to the elongated spacer frame member to a distance above the spacer frame member that corresponds to the width of the spacer frame member.

5. The method of claim 1 further comprising adjusting a width of the desiccant material applied by the nozzle at the delivery site to the elongated spacer frame member by adjusting a relative distance between the spacer frame member and the selected nozzle at the delivery site.

6. The method of claim 1 further comprising:

automatically vertically adjusting the selected one nozzle that corresponds to the width of the spacer frame member with respect to the elongated spacer frame member to a distance above the spacer frame member that corresponds to the width of the elongated spacer frame member.

7. The method of claim 1 wherein indexing one of the plurality of nozzles to the delivery site comprises linearly moving a nozzle carrying plate.

8. The method of claim 1 wherein indexing one of the plurality of nozzles to the delivery site comprises rotating a turret manifold.

9. A method of controlling dispensing of a desiccant material into an interior region of an elongated spacer frame member, comprising:

a) moving an elongated spacer frame member along a path of travel relative to a delivery site at a controlled speed;

b) automatically indexing a selected nozzle from a plurality of available nozzles to a delivery site located along the path of travel of the elongated spacer frame member; and c) delivering controlled amounts of the desiccant material through the selected nozzle at the delivery site to the interior region of the elongated spacer frame member;

d) wherein a volume of desiccant material per unit of spacer frame member length applied by a nozzle is based on a moisture vapor transfer rate of an insulated glass unit constructed with the elongated spacer frame member.

10. The method of claim 9 wherein the volume of desiccant material per unit of spacer frame member length is constant for a range of spacer frame widths.

11. A method of controlling dispensing of a desiccant material into an interior region of an elongated spacer frame member, comprising:

a) monitoring widths of elongated spacer frame members that are moved along a path of travel;

b) moving a first elongated spacer frame member having a first width along the path of travel relative to a delivery site at a controlled speed;

c) automatically positioning a first nozzle that corresponds to the first width at the delivery site;

d) delivering controlled amounts of the desiccant material through the first nozzle at the delivery site to the interior region of the first elongated spacer frame member;

e) moving a second elongated spacer frame member having a second width along the path of travel relative to a delivery site at a controlled speed;

f) automatically positioning a second nozzle that corresponds to the second width at the delivery site; and g) delivering controlled amounts of the desiccant material through the second nozzle at the delivery site to the interior region of the second elongated spacer frame member.

12. The method of claim 11 wherein the first nozzle corresponds to a range of elongated spacer frame widths.

13. The method of claim 11 further comprising automatically vertically adjusting the first nozzle with respect to the path of travel based on the first width.

14. The method of claim 11 further comprising adjusting a width of the desiccant material applied by the first nozzle at the delivery site to the first elongated spacer frame member by adjusting a relative distance between the first spacer frame member and the first nozzle at the delivery site.

15. The method of claim 11 wherein a volume of desiccant material per unit of spacer frame member length applied by a nozzle is based on a moisture vapor transfer rate of an insulated glass unit constructed with the first elongated spacer frame member.

16. The method of claim 15 wherein the volume of desiccant material per unit of spacer frame member length is constant for a range of spacer frame widths.

17. The method of claim 11 wherein the first and second nozzles are positioned by linearly moving a nozzle carrying plate.

18. The method of claim 11 wherein the first and second nozzles are positioned by rotating a nozzle carrying disk.

19. A method of controlling dispensing of a desiccant material into an interior region of an elongated spacer frame member, comprising:

a) monitoring widths of elongated spacer frame members that are moved along a path of travel;

b) moving a first elongated spacer frame member having a first width along the path of travel relative to a delivery site at a controlled speed;

c) automatically positioning a nozzle at a first distance above the path of travel that corresponds to the first width;

d) delivering controlled amounts of the desiccant material through the nozzle at the delivery site to the interior region of the first elongated spacer frame member;

e) moving a second elongated spacer frame member having a second width along the path of travel relative to a delivery site at a controlled speed;

f) automatically positioning the nozzle at a second distance above the path of travel that corresponds to the second width; and g) delivering controlled amounts of the desiccant material through the nozzle at the delivery site to the interior region of the second elongated spacer frame member.

20. The method of claim 19 wherein positioning the nozzle above the path of travel adjusts a width of the desiccant material applied by the nozzle at the delivery site.

21. The method of claim 19 wherein a volume of desiccant material per unit of spacer frame member length applied by the nozzle is based on a moisture vapor transfer rate of an insulated glass unit constructed with the first elongated spacer frame member.

22. The method of claim 21 wherein the volume of desiccant material per unit of spacer frame member length is constant for the first elongated spacer frame member and the second spacer frame member.

23. A method of controlling dispensing of a desiccant material into an interior region of an elongated spacer frame member, comprising:

a) monitoring widths of elongated spacer frame members that are moved along a path of travel;

b) automatically positioning a nozzle with respect to the path of travel based on monitored widths of the elongated spacer frame members;

c) moving the elongated spacer frame member along the path of travel relative to the delivery site at a controlled speed;

d) delivering controlled amounts of the desiccant material through the nozzle at the delivery site to the interior region of the elongated spacer frame member.

24. The method of claim 23 wherein automatically positioning the nozzle with respect to the path of travel comprises vertically adjusting the nozzle with respect to the path of travel based on a width of an elongated spacer frame member approaching the delivery site.

25. The method of claim 23 wherein positioning the nozzle with respect to the path of travel adjusts a width of the desiccant material applied by the nozzle at the delivery site to the elongated spacer frame member.

26. The method of claim 23 wherein a volume of desiccant material per unit of spacer frame member length applied by the nozzle is based on a moisture vapor transfer rate of an insulated glass unit constructed with the elongated spacer frame member.

27. The method of claim 26 wherein the volume of desiccant material per unit of spacer frame member length is constant for a range of spacer frame widths.

* * * * *